US006056628A

United States Patent [19]

Bergqvist et al.

[11] Patent Number: 6,056,628

[45] Date of Patent: May 2, 2000

[54] GRINDING CUP AND WEAR PART WITH VIBRATION DAMPENING MEANS

[75] Inventors: Arne Bergqvist; Peter Nava, both of Sandviken, Sweden

[73] Assignee: Sandvik AB, Sandviken, Sweden

[21] Appl. No.: 08/913,443

[22] PCT Filed: Apr. 18, 1996

[86] PCT No.: PCT/SE96/00494

§ 371 Date: Oct. 20, 1997

§ 102(e) Date: Oct. 20, 1997

[87] PCT Pub. No.: WO96/33045

PCT Pub. Date: Oct. 24, 1996

[30] Foreign Application Priority Data

Apr. 20, 1995 [SE] Sweden ..... 959501438

[51] Int. Cl.[7] ..... B24B 27/00

[52] U.S. Cl. ..... 451/177; 451/548; 451/559; 451/450

[58] Field of Search ..... 451/48, 910, 449, 451/450, 548, 559, 177

[56] References Cited

U.S. PATENT DOCUMENTS 2,542,154 2/1951 Mesirow .
2,666,307 1/1954 Higert .

FOREIGN PATENT DOCUMENTS 469 970 10/1993 Sweden .
WO 93/25346 12/1993 WIPO .

*Primary Examiner*—Timothy V. Eley
*Attorney, Agent, or Firm*—Burns, Doane, Swecker & Mathis, L.L.P.

[57] ABSTRACT

The present invention relates to a grinding cup and a wear part for grinding of cutting inserts of a rock drill bit. The grinding cup is provided to be rotatably mounted in a grinding machine. The grinding cup is provided to perform grinding of cutting inserts of a rock drill bit. The grinding cup comprises a shank, a flush channel, and a wear part having a recess. The grinding cup has a center axis and is provided with vibration dampening means. The wear part is resilient in the grinding cup in at least the axial direction relative to the shank and the vibration dampening means forms contact surfaces with cooperating parts. The contact surfaces have substantially the same radial extension.

15 Claims, 2 Drawing Sheets

GRINDING CUP AND WEAR PART WITH VIBRATION DAMPENING MEANS

TECHNICAL FIELD

The present invention relates to a grinding cup for grinding of cutting inserts of a rock drill bit, said grinding cup comprising a shank rotatably mounted in a grinding machine and a wear part being provided with a recess effectuating the grinding of the cutting inserts. The invention also relates to a wear part for the grinding cup.

PRIOR ART

During grinding of cemented carbide cutting inserts of a drill bit, a grinding cup of the above-captioned type is often used. The wear part of such a grinding cup usually has an abrasive grinding surface which often comprises diamond particles. A grinding cup for a handheld insert grinding machine is known through SE-B-469 970. The grinding cup is provided with a specially designed rubber bushing, which has been mounted to the shank of the grinding cup. The function of the bushing is to decrease the transfer of vibrations from the grinding cup to the handheld holder body of the grinding cup. The bushing is however, mechanically unprotected, such that the bushing may be subjected to mechanical and abrasive loads.

SUMMARY OF THE INVENTION

An object of the present invention is to provide a grinding cup that reduces transfer of vibrations from the grinding cup to the grinding spindle in connection with grinding of drill bit cutting inserts by avoiding entrance of abrasive material to the active contact surfaces. Other objects of the present invention is to provide a grinding cup that has a good stability and a good length of life. The above-mentioned objects have been achieved by providing a grinding cup that is characterized by the features of the appended claims.

DESCRIPTION OF THE FIGURES

Below embodiments of a grinding cup according to the present invention will be described with reference to the appended drawings, wherein.

DETAILED DESCRIPTION OF THE INVENTION

Figure 1:
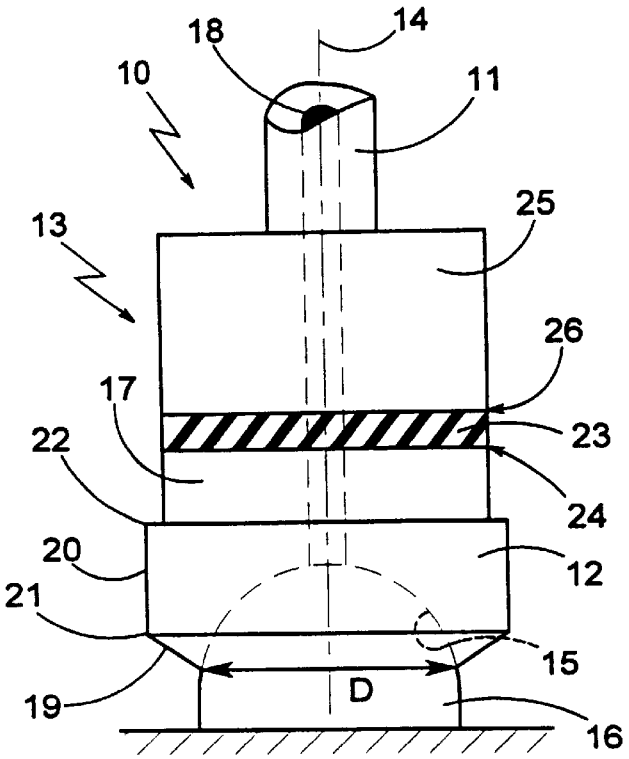
FIG. 1 shows a side view of a grinding cup according to the present invention.

The grinding cup 10 according to FIG. 1 comprises a shank 11, a wear part 12 and an intermediate portion 13 connecting the shank 11 with the wear part 12. Preferably the shank 11 and the intermediate portion 13 are made in one piece. The intermediate portion consists of a number of connected components, see below. The grinding cup 10 is rotationally symmetric relative to its longitudinal center axis 14.

The free end of the wear part 12 has a recess 15 in the shape of a spherical segment, when the cutting inserts 16 to be ground have semi-spherical free ends. The cutting insert is preferably made of cemented carbide. If the cutting insert however, has ballistic, conical or other shape on its free end, the recess will of course have a corresponding shape. The recess 15 is adapted to be in engagement and cooperate with the free end of a cutting insert to be ground. The wear part is made of sintered powder and at least the recess is being provided with an abrasive material, preferably diamond. The other parts of the grinding cup is preferably made from steel.

The intermediate portion 13 of the grinding cups 10 can be provided with a key grip at its upper portion provided to cooperate with a driving means of the grinding machine to rotate the grinding cup 10. A central flush channel 18 extending axially, extends between the free end of the shank 11 and a central and/or eccentric orifice in the recess 15. The shank 11 and the intermediate portion 13 may alternately be provided with other conventional geometries, suited for different kinds of grinding machines available on the market.

The radially outermost border line of the recess 15 has a diameter D. Radially outside the outermost border line, the wear part is provided with a backed-off conical surface 19 or a circular surface perpendicular to the center axis 14. Said surface 19 connects to the jacket surface 20 of the wear part over an obtuse 21 or perpendicular corner. The jacket surface connects to a first part 17 of the intermediate portion 13, either continuously or via a transition such as a corner 22. The part 17 has an outer diameter which may be larger than but preferably equal to or less than the diameter of the jacket surface. The first part is preferably made integral with the wear part. The wear part 12 may alternately be bonded to the first part 17 in another manner, preferably by brazing. The first part 17 is firmly connected via a first joint 24 to a second part 23 by gluing or vulcanization. The second part 23 consists of a flexible, vibration dampening material, such as rubber for example. The second part is furthermore connected to a third part 25 of the portion 13, which in turn is connected to the shank 11. The third part 25 is firmly connected via a first joint 26 to the second part 23 by gluing or vulcanization. The center hole of the second part has a diameter that preferably is larger than the diameter of the flush channel 18 to avoid decrease in flow. The joint surfaces 24 and 26 are preferably plane parallel and perpendicular to the center axis 14 of the grinding cup. Alternately the joint surfaces may be curved. The flush channel 18 extends centrally through the parts 17, 24 and 25. The diameters of the latter parts are substantially equal and preferably larger than the diameter D of the recess, said grinding cup obtaining a relatively good stability, via guiding radially close to the jacket surface or in the jacket surface, simultaneously as transfer of the vibrations is prevented.

The described grinding cup 10 functions as follows. The grinding cup 10 is mounted in the rotatable spindle of a grinding machine. The grinding cup is thereafter adjusted in position relative to the cutting insert to be ground, i.e. in a position where the wear part 12 is in contact with the cutting insert. The grinding cup 10 is then rotated to perform grinding of the cutting insert.

Flushing medium is supplied from an outer source to the recess 15 via the flush channel 18. Substantially all flushing medium shall be supplied to the active surface of the cutting insert. Driving of the wear part 12 is done via the second part 23, which is flexible in both the tangential and axial directions and the vibrations that arise will be leveled in the part 23.

Figure 2:
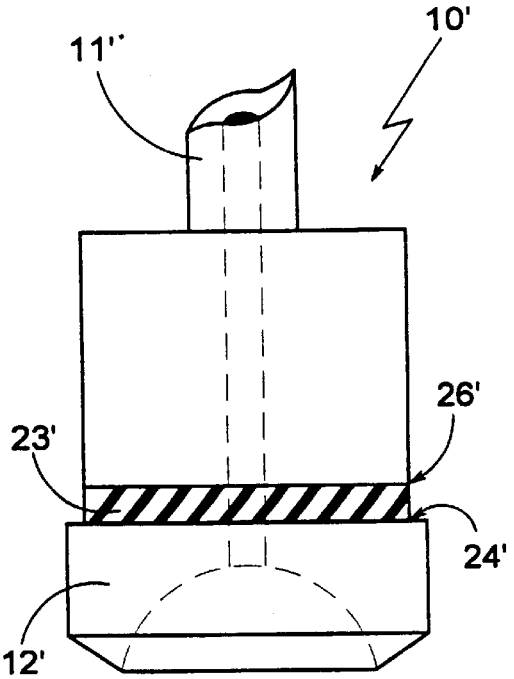
FIG. 2 shows a side view of an alternative embodiment of a grinding cup according to the present invention.

In FIG. 2 is shown an alternative embodiment of a grinding cup 10' according to the present invention. The only thing that differs from the embodiment according to FIG. 1 is that the second part 17 of the intermediate portion 13 has been expelled and thus that the second part 23' has been joined directly to the wear part 12' via the joint surface 24'. The third part 25' is thus a larger piece of the part 13' compared to the embodiment according to FIG. 1. Otherwise the information given in connection with FIG. 1 is true also for this embodiment.

Figure 3:
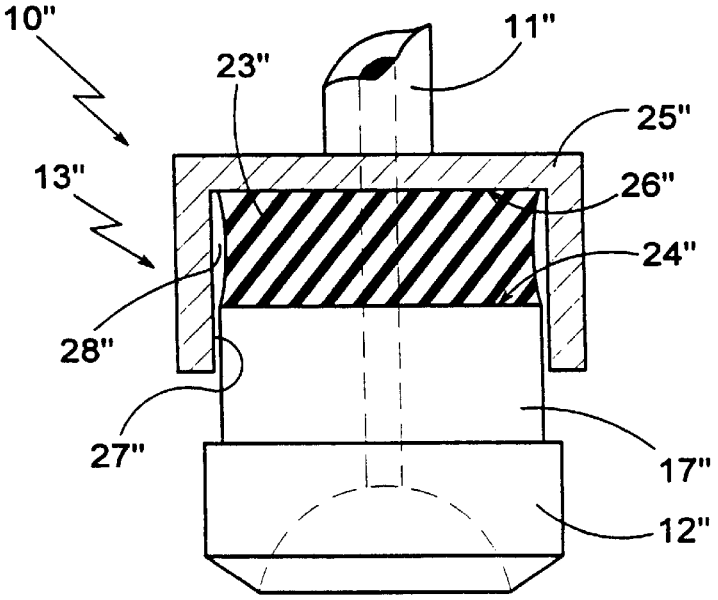
FIG. 3 shows a side view of still another alternative embodiment of a grinding cup according to the present invention.

In FIG. 3 is shown still another alternative embodiment of a grinding cup 10" according to the present invention. The only thing that differs from the embodiment according to FIG. 1 is primarily that the third part 25" of the intermediate portion 13" has the shape of a socket. The socket has a central cylindrical cavity 27", which is provided to receive a flexible second part 23" in its entirety and partly the first part 17". The second part 23" is vulcanized or glued to the socket and to the first part via joint surfaces 24" and 26". The joint surfaces are preferably plane parallel and perpendicular to the center axis of the grinding cup. A gap 28" is provided in the radial direction between the second part 23" and the cylindrical wall of the cavity 27", in order to create a space for expansion for the part 23", which is needed when the grinding cup 10" is subjected to axial load. An advantage with this alternative embodiment is that the part 17" can be guided by the cylindrical inside of the socket at angled loads on the wear part 12".

The three embodiments 10–10" described above provide the advantage that the grinding cup reduces transfer of vibrations from the grinding cup to the grinding spindle in connection with grinding of drill bit cutting inserts in combination with a simple handling and a good length of life.

Figure 4:
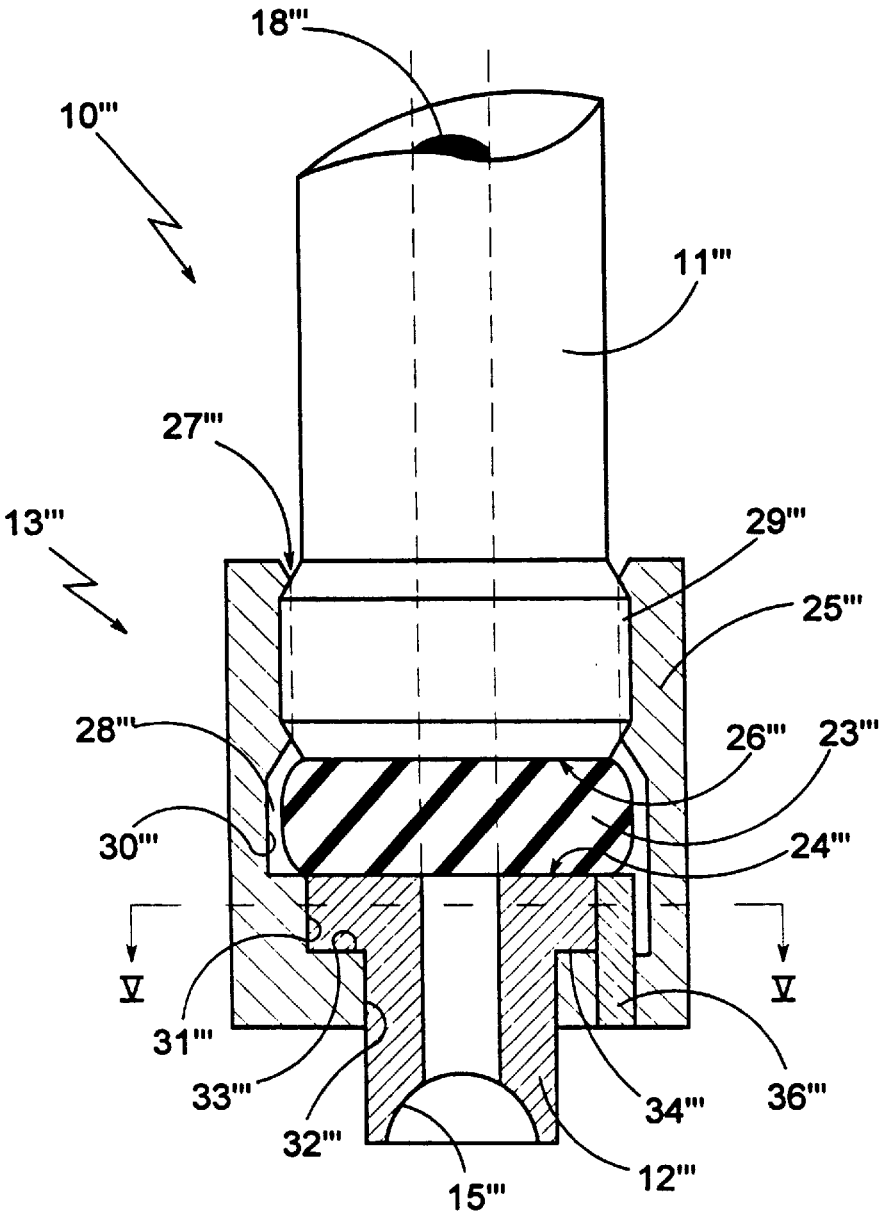
FIG. 4 shows still another alternative embodiment of a grinding cup according to the present invention, in a partly sectioned side view.
Figure 5:
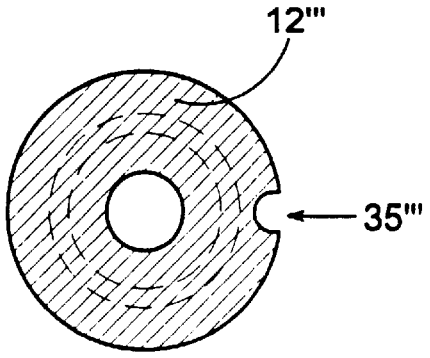
FIG. 5 shows a cross-section of an exchangeable wear part according to the present invention, according to the line V—V in FIG. 4.

In FIGS. 4 and 5 is shown still another alternative embodiment of a grinding cup 10''' according to the present invention, partly in cross-section. The shank 11''' has an external thread at its free end, which in a threaded connection 29''' cooperates with an internal thread of the intermediate portion 13''' of the third part 25'''. The part 25''' has an internal cavity 27''' which consists of at least two substantially cylindrical surfaces, an upper surface 30''' of which has a larger diameter than a lower surface 31'''. The threaded connection provided to tightened in working direction of the machine. The second part 23''' consists of a flexible means which dismountably abuts against the wear part and the shank via contact surfaces 24''' and 26''', respectively. A radial gap 28''' is provided between the part 23''' and the upper surface 30''', in order to create a space for expansion for the part 23''', which is needed during axial loading of the grinding cup 10'''. The wear part is partly received by the lower surface 31''' and in a central hole 32''' connected to the latter surface. A collar 33''' is provided between the hole and the lower surface. The collar cooperates with a peripheral shoulder 34''' on the wear part, facing towards the recess 15''', to form an axially forward stop. A groove 35''' is provided in the shoulder to receive a driving pin 36''', axially secured in the part 25'''.

The described grinding cup 10''' is mounted as follows. The wear part 12''' is placed in the part 25''' such that the pin enters the groove 35''' whereafter the wear part is pushed down, such that the shoulder and the collar mutually engage. Then the means 23''' is placed in position to abutment against a rear side of the wear part, the largest diameter of said means preferably being less than the smallest diameter of the threaded portion of the part 25'''. Then the threaded connection 29''' is tightened until the part 23''' has been compressed to a desired degree. An advantage with this alternative embodiment is that the wear part 12''' may be exchanged separately, such that the same shank may be used for grinding different shapes of cutting inserts. Furthermore, the rigidity and the neutral frequency of the grinding cup can be adjusted depending on machining conditions.

The present invention thus relates to a grinding cup where the wear part is resilient in the grinding cup in at least the axial direction relative to the shank and where the resilient means forms contact surfaces with connecting parts, said contact surfaces having substantially the same radial extension. By that the grinding cup will achieve a good length of life by avoiding entrance of abrasive material to the contact surfaces. The means 23–23''' preferably seals between the shank and the wear part such that the flow of flushing medium is maintained. It is understood that the flush channel in the wear part may be centrally or eccentrically placed.

What is claimed is:

1. A grinding cup provided to be rotatably mounted in a grinding machine, said grinding cup being provided to perform grinding of cutting inserts of a rock drill bit, said grinding cup having a central axis and comprising a shank, at least one flush channel and a wear part, which includes a recess wherein the flush channel terminates, said recess performing the grinding of the cutting inserts, said grinding cup being provided with vibration dampening means, wherein the wear part is provided resilient in the grinding cup in at least an axial direction relative to the shank, said vibration dampening means including a contact surface which is disposed against an additional contact surface, said contact surfaces having substantially the same radial extension from said central axis.

2. Grinding cup according to claim 1, wherein the contact surfaces are substantially plane parallel and perpendicular to the center axis of the grinding cup and that the contact surfaces are provided axially in front of the shank.

3. Grinding cup according to claim 1, wherein the vibration dampening means comprises a central hole with at least substantially the same diameter as a diameter of the flush channel.

4. Grinding cup according to claim 1, wherein a space is provided in the radial direction about the vibration dampening means for the purpose of allowing radial expansion of the vibration dampening means.

5. Grinding cup according to claim 1, wherein the contact surfaces have at least substantially the same diameter as the largest diameter of the recess.

6. Grinding cup according to claim 1, wherein the vibration dampening means consists of a hollow disc or a hollow cylindrical piece of rubber and that the vibration dampening means is glued, vulcanized or clamped against the additional contact surface.

7. A wear part for a grinding cup provided to be rotatably mounted in a grinding machine for grinding of cutting inserts of a rock drill bit, said wear part being provided to be secured to a shank, a flush channel being provided to supply flushing medium to the wear part, which has a recess, said recess performing the grinding of the cutting inserts, said wear part including a vibration dampening means and having a substantially cylindrical basic shape and a center axis, wherein the wear part is provided with an axially rear surface, facing away from the recess, that is provided to constitute a mechanically connected support surface against said vibration dampening means.

8. Wear part according to claim 7, wherein that the surface has a substantially circular ring shape around the flush channel.

9. Wear part according to claim 7, wherein that a peripheral shoulder facing towards the recess, is provided on the wear part and that the wear part has driving means.

10. Wear part according to claim 7, wherein that the vibration dampening means is connected to an axially rear surface of the wear part.

11. A grinding cup for a grinding machine, comprising:

a shaft for rotatable mounting in a grinding machine, said shaft including a channel and having a central axis;

a wear part including a recess for the grinding of cutting inserts, said wear part being disposed about the shaft;

an intermediate portion affixed to said shaft; and vibration dampening means disposed about said shaft, said vibration dampening means being connected between said intermediate portion and said wear part via contact surfaces, said contact surfaces having substantially the same radial extension from said central axis.

12. The grinding cup of claim 11, wherein said intermediate portion and said shaft are integrally formed.

13. The grinding cup of claim 11, wherein said intermediate portion and said vibration dampening means are connected by glue, vulcanization, or clamping.

14. The grinding cup of claim 11, wherein said vibration dampening means comprises a central hole with at least substantially the same diameter as a diameter of said conduct of said shaft.

15. The grinding cup of claim 11, wherein said vibration dampening means is cylindrical and made from rubber.

* * * * *